United States Patent [19]

Wetzler

[11] Patent Number: 4,735,236

[45] Date of Patent: Apr. 5, 1988

[54] MULTIPLE YARN INSERTION DEVICE

[75] Inventor: Dallas G. Wetzler, Florissant, Mo.

[73] Assignee: The United States of America as represented by the Secretary of the Air Force, Washington, D.C.

[21] Appl. No.: 916,965

[22] Filed: Oct. 8, 1986

[51] Int. Cl.[4] ..... D03D 37/00

[52] U.S. Cl. ..... 139/13 A

[58] Field of Search ..... 139/13 R, 13 A, 14, 139/13 B, 11

[56] References Cited

U.S. PATENT DOCUMENTS

| | | | |
|---|---|---|---|
| 190,566 | 5/1877 | Dumas . | |
| 558,753 | 4/1896 | Allen . | |
| 686,555 | 11/1901 | Sussman . | |
| 2,091,333 | 8/1937 | Pool | 139/13 |
| 2,206,982 | 7/1940 | Thompson | 139/13 |
| 2,454,146 | 11/1948 | Ezbelent | 139/13 R |
| 2,601,871 | 7/1952 | Ancet | 139/13 R |
| 2,630,837 | 3/1953 | Cole | 139/13 |
| 2,646,079 | 7/1953 | Christiansen et al. | 139/13 R |
| 2,659,393 | 11/1953 | Dunod | 139/13 R |
| 2,696,836 | 12/1954 | Caldes | 139/13 R |
| 2,870,349 | 1/1959 | Rosenberg et al. | 139/13 R |
| 3,633,632 | 1/1972 | Emerson et al. | 139/13 |
| 3,719,210 | 3/1973 | Emerson et al. | 139/13 |
| 3,871,413 | 3/1975 | Torii | 139/13 R |

*Primary Examiner*—Harvey C. Hornsby
*Assistant Examiner*—Joseph S. Machuga
*Attorney, Agent, or Firm*—William G. Auton; Donald J. Singer

[57] ABSTRACT

A circular loom which holds multiple longitudinal threads is able to weave them into a three-dimensional fabric using a filament insertion device which supplies it with multiple circumferential threads and a supply of weaver thread. One version of the filament insertion device uses two spools of circumferential thread which each have feed tubes and tensionmeters which supply two lines of circumferential thread to a filament insertion device tip so that it may dispense two circumferential threads with adjustable tensions simultaneously to said circular loom. A weaver spool and weaver feed tube supply the filament insertion device tip with a tensionless supply of weaver thread so that it may dispense weaver thread when required.

4 Claims, 3 Drawing Sheets

MULTIPLE YARN INSERTION DEVICE

STATEMENT OF GOVERNMENT INTEREST

The invention described herein may be manufactured and used by or for the Government for governmental purposes without the payment of any royalty thereon.

BACKGROUND OF THE INVENTION

The present invention relates generally to threedimensional polar weaving machines, and more particularly to a filament insertion device which is capable of inserting multiple yarns within a circular loom.

Circular looms are used to weave a three dimensional fabric from yarns such as carbon, graphite, quartz, steel and certain organic polymeric fibers including the polyimides which are resistant to high temperatures and which exhibit excellent tensile properties when subjected to high temperatures.

Exemplary in the art are the systems described in the following U.S. Patents, the disclosures of which are incorporated herein by reference:

U.S. Pat. No. 190,566 issued to Dumas on May 8, 1877;

U.S. Pat. No. 558,753 issued to Allen on Apr. 21, 1896;

U.S. Pat. No. 686,555 issued to Sussman on Nov. 12, 1901;

U.S. Pat. No. 2,091,333 issued to Pool on Aug. 31, 1937;

U.S. Pat. No. 2,206,982 issued to Thompson on July, 9, 1940;

U.S. Pat. No. 2,630,887 issued to Cole on Mar. 10, 1953;

U.S. Pat. No. 3,633,632 issued to Emerson et al on Jan. 11, 1972;

U.S. Pat. No. 3,719,210 issued to Emerson et al on Mar. 6, 1973; and

U.S. Pat. No. 3,750,710 issued to Holman et al on Aug. 7, 1973.

The references cited above constitute a synopsis of the development of weaving technology in this country. The disclosures of Duman, Allen, Sussman and Cole describe the basic shuttles used in looms. The Pool, Thompson, Emerson et al U.S. Pat. No. 3,633,632 and Holman et al references are directed specifically at circular loom technology. Pool discloses a starting mechanism for a circular loom. Thompson describes the weaving operation of circular looms. Emerson et al., U.S. Pat. No. 3,719,210 and Holman et al describes circular loom systems.

A circular loom weaves one or more circumferential threads into a three-dimensional configuration of longitudinal threads which are suspended in a desired configuration in a weave plane. Usually, only one circumferential thread is inserted at a time, and conventional circular looms have multiple shuttles, each supplying in a single circumferential or weave thread to the weave plane. It has been observed that the insertion of two yarns at a time could reduce the insertion device run time by 40%. Reducing the number of insertion device rotations would also reduce the amount of damage to the longitudinal yarns and improve the quality of fabric.

In view of the foregoing, it is apparent that there exists the need for a filament insertion device which is capable of inserting multiple yarns within a circular loom. The present invention is intended to satisfy that need.

SUMMARY OF THE INVENTION

The present invention is a multiple yarn insertion device capable of supplying a plurality of threads to the weave plane of a circular loom. One embodiment of the invention supplies two circumferential threads and a weave thread using: two spools, two tensionmeters, two feed tubes, a weaver yarn spool, a weaver yarn tube, and a single filament insertion device (FID) tip.

The two spools, tensionmeters and feed tubes work in concert to simultaneously supply two circumferential threads to the FID tip with controllable tension. The weaver yarn spool supplies the FID tip with weaver thread. An adjustable positioning support tube supports the FID tip in the weave plane of the circumferential loom so that it can either dispense the two circumferential threads simultaneously, or dispense just the weaver thread.

It is an object of the present invention to supply a circumferential weaving loom with multiple circumferential threads using a single filament insertion device.

It is another object of the present invention to reduce the filament insertion device run time.

These objects together with other objects, features and advantages of the invention will become more readily apparent from the following detailed description when taken in conjunction with the accompanying drawings wherein like elements are given like reference numerals throughout.

DETAILED DESCRIPTION OF THE PREFERRED EMBODIMENT

The present invention includes a filament insertion device which supplies multiple threads of yarn to the weave plane of a circular loom.

Figure 1:
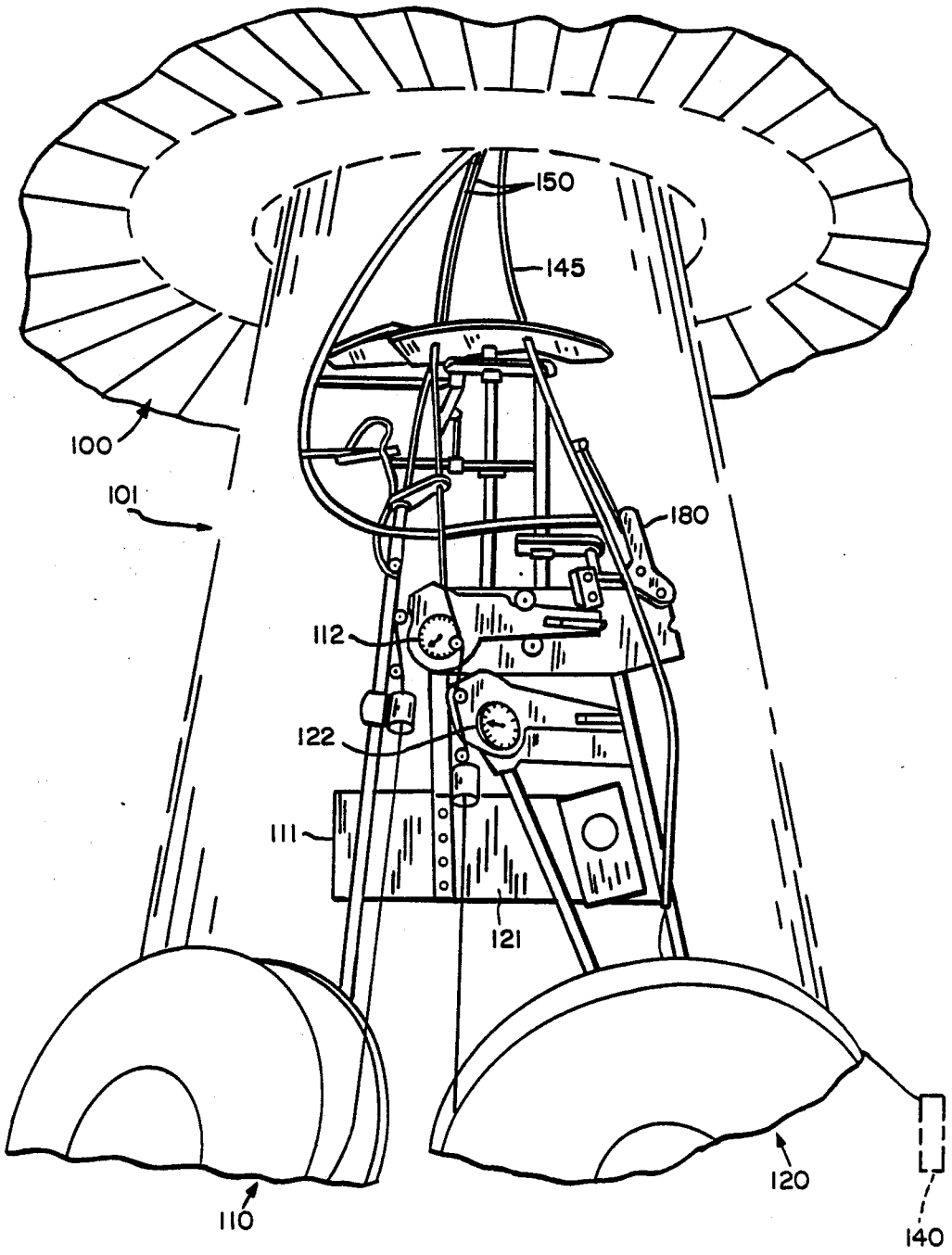
FIG. 1 is an illustration of a circumferential loom which is supplied with circumferential thread by the present invention.

The reader's attention is now directed towards FIG. 1, which is an illustration of an embodiment of the present invention. In FIG. 1, a circular loom 100 weaves a plurality of longitudinal threads 101 into a three-dimensional fabric by interleaving circumferential and weaver threads supplied by the filament insertion device of the present invention.

The particular filament insertion device of FIG. 1 is the twin circumferential yarn configuration (TCYC). This means it simultaneously supplies two circumferential threads to the weave plane, and has the capability of supplying weaver threads as well using: two spools 110, 120; two yarn guides, 111, 121; two tensionmeters 112, 122; two feed tubes 113, 123; a supply of weaver yarn 140; and a filament insertion device tip 150. The details of the filament insertion device of FIG. 1 are more clearly depicted in FIG. 2. Note that the row of warp threads is removed from the views provided in FIGS. 1 and 3.

Figure 2:
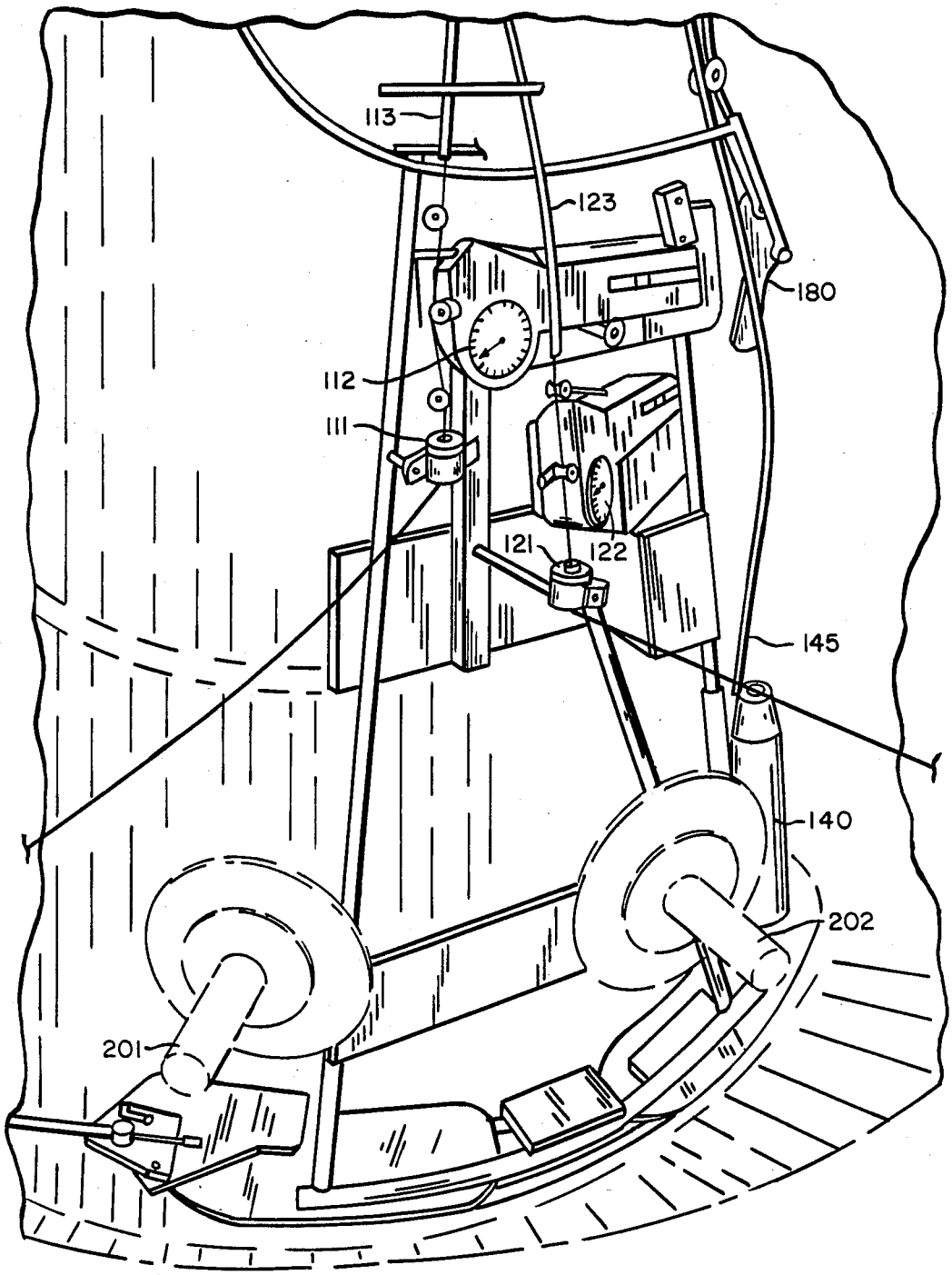
FIG. 2 is a detailed illustration of the lower half of the filament insertion device of FIG. 1.

FIG. 2 is a detaied illustration of the lower half of the multiple yarn insertion device of FIG. 1. In FIG. 2, an upper yarn spindle 201 is used to hold the first spool 110 of FIG. 1, and a lower yarn spindle 202 holds the second spool 120. The upper yarn guide 111, upper yarn tensionmeter 112 and upper yarn feed tube 113 supply the FID tip 150 of FIG. 1 with a supply of upper circumferential thread which has controllable tension. Similarly the lower yarn spindle 202, lower yarn guide 121, lower yarn tensionmeter 122 and lower yarn feed tube 123 supply the FID tip 150 with a supply of lower circumferential yarn which has controllable tension. The weaver yarn spool 140 and weaver yarn feed tube 145 supplies tensionless weaver thread to the FID tip 150. As indicated above, both the circumferential threads have controlled tensions (which are each controlled by the tensionmeters) and are interwoven circumferentially with the longitudinal threads to join a three dimensional fabric. The purpose of the controlled tension is as described in both the above-cited Emerson et al. references. More specifically, changes in tension in the circumferential thread exert changes in the fabric shape to produce a three-dimensional shape. As shown in both Emerson et al. references, the fabric may be woven in the shape of "a cylinder, a truncated cone, or irregular shapes such as that of an airplane wing,". This is possible because as greater tension is put on the circumferential threads, they are wound tighter and tend to pull inwards the longitudinal threads. With less tension on the circumferential threads, the longitudinal threads are pulled in less and the circumference of the fabric enlarges.

The weaver threads (also known as weft threads) are distinct from the circumferential threads in that the weaver threads are tensionless, which when interwoven with the longitudinal threads produce a cylinder. Note that the weaver threads are woven circumferentially, but are used as an alternative to the tension-controlled circumferential threads. When a three-dimensional fabric with varying circumferences is required (as in the Emerson et al. references), the circumferential threads are used. If a cloth cylinder is required, the weaver thread may be used in the manner of the above-cited Thompson reference.

Figure 3:
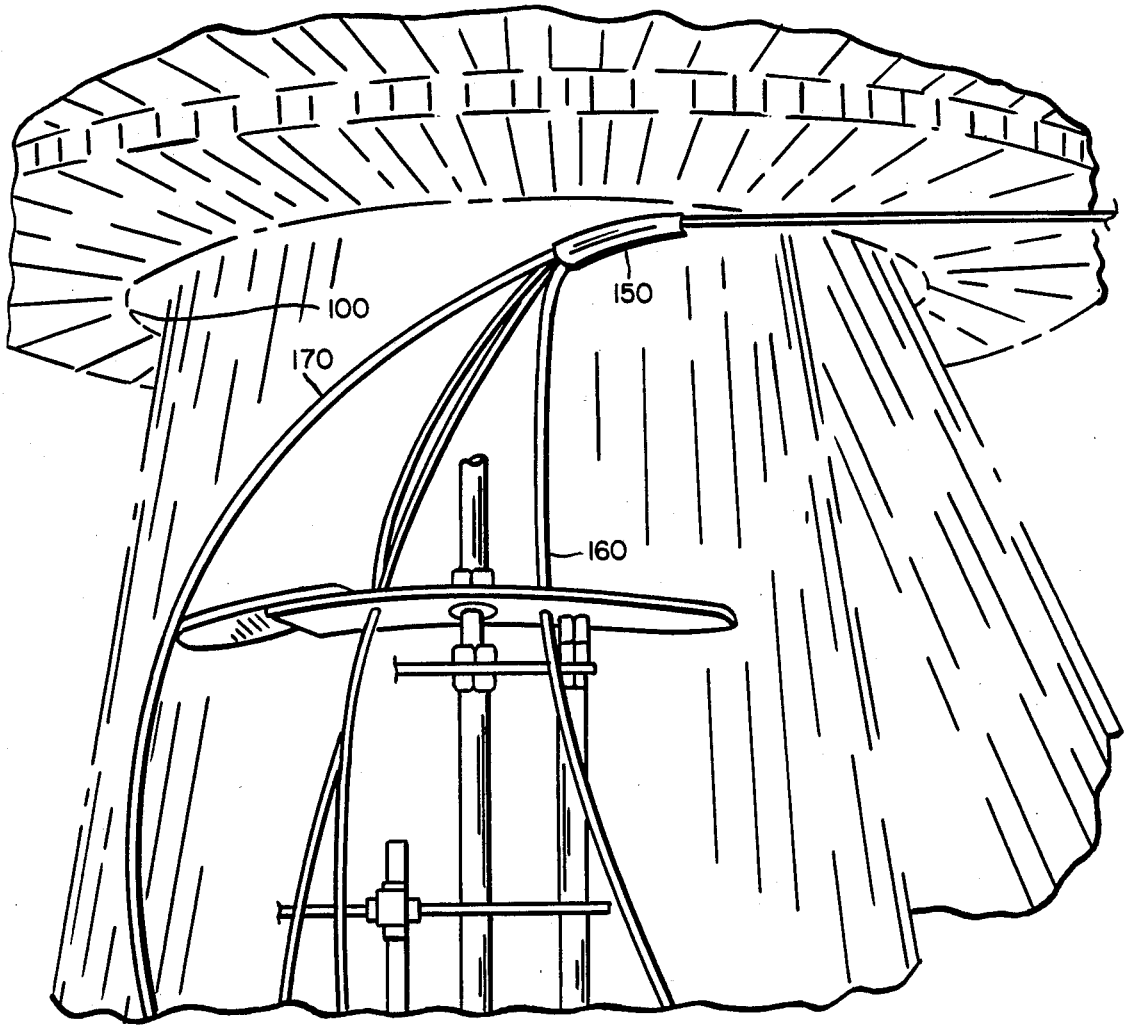
FIG. 3 is a detailed illustration of the upper half of the filament insertion device of FIG. 1.

FIG. 3 is a detailed illustration of the upper half of the multiple yarn insertion device of FIG. 1. The FID tip 150 supplies the auto packer assembly 100 of the circumferential loom with two circumferential threads with independently adjustable tensions as well as tensionless weaver thread. In operation, the upper and lower circumferential threads are either dispensed simultaneously or not at all the weaver thread is dispensed through the FID tip 150 when the circumferential threads are not being dispensed. In other words, the circular loom should dispense either the circular threads (with controlled tension) or the tensionless weaver threads. Since the principal object is to weave three-dimensional fabrics, the circumferential threads will normally be used in the manner of the Emerson et al. references. However, if no change in the circular shape is needed (e.g., a cylinder is being woven), the tensionless weaver thread may be used directly from the weavers spool. One method of insuring that the circumferential threads are not dispensed entails simply setting the tensionmeters at a high setting so that the circumferential threads do not feed (or snap if any are being fed). The tensionless weaver thread, once started, will automatically flow in the manner of the above-cited Thompson reference. Therefore the FID tip 180 does not necessarily "switch" between the circumferential threads and the weaver thread: it can simply be used to dispense either the weaver threads or the circumferential threads. However, note that the Emerson et al. reference does describe more elaborate weaving mechanisms which could be used as a dynamic FID tip, and and actually dynamically switch during weaving between the weaver and circumferential threads.

The FID tip 150 receives the circumferential threads and the weaver threads from appropriate feed tubes, as discussed above. Additionally, the FID tip is positioned in place by the positioner support tube 160. The positioner support tube 160 of FIG. 3 positions the FID tip 150 at two different positions. When circumferential threads are being dispensed, the FID tip 150 is actually positioned in the weave plane. However, the weaver thread is dispensed at one and one-half inches below the weave plane. A positioning handle 180 is depicted in FIG. 2 to illustrate the device which causes the positioner support tube 160 to raise and lower the FID tip 150 so that it might dispense circumferential threads and weaver threads as required.

Since the circumferential threads have controlled tension to vary the shape of the fabric, it is best that the FID tip 150 dispense them in the weaver plane. This allows the tension to be exerted without any angles which would pull at the woven fabric. The tensionless weaver yarn can be dispensed below the weave plane without adverse effects because it has no tension. Thus dispensed by the FID tip 150, it will automatically flow into the weave plane in the manner of the above-cited Thompson reference. The FID tip 150 is normally held directly even with the weave plane at the shed by the shed finder tube 170 and the positioner support tube 160. When the FID tip positioning handle 180 is pulled, it physically displaces the FID positioner support tube to raise or lower the FID tip 150 as described above.

As mentioned above, the weaver thread is supplied with essentially no tension, therefore, it passes directly from the weaver yarn spool to the weaver yarn feed tube. All three feed tubes, two for circumferential yarn and one for weaver yarn come together at the FID tip and or supported on the shed finder tube 170 and FID positioner support tube 160. The shed finder tube 170 enables the FID tip 150 to insert circumferential thread at the shed. (Shed is a term used for the opening made in longitudinal yarns which the FID passed through when installing the circumferential yarns or weaver yarn.) The two circumferential yarns are put in simultaneously whereas the weaver yarn is installed by itself. The circumferential yarn is installed in very close proximity to the weaver plane whereas the weaver yarn is installed about one and one-half inches below the weave plane and then pushed up to the weave planes. The autopacker assembly which is shown just above the FID tip is used to pack the circumferential yarns and weaver yarn respectively during the weaving operation. As mentioned above, the FID tip must be moved to accommodate the one and one-half inch difference in installation levels for installing the weaver yarn and circumferential yarn. This is accomplished by the FID tip positioning handle/FID positioner support tube. The FID tip positioning handle in the Up position is for installing circumferential yarns. The FID tip positioning handle in the Down position is for installing weaver yarn.

Large spools are used for the circumferential yarns as shown in FIG. 1 to minimize tension variance from full to empty spool. Tension is set by controlling the torque required to rotate the circumferential yarn spools. (i.e.

diameter change as a result of yarn being used is minimized for a given torque.)

The installation of multiple yarns with the filament insertion device reduces the cost of fabrication. The installation of two yarns at a time reduces the amount of FID insertion device run time by 40%. Reducing the number of FID rotations required (i.e. manipulations required of the longitudinal yarns) also reduces the amount of damage to the longitudinal yarns and therefore results in a higher quality of woven part. The multiple insertion device (new improved FID) also employed larger diameter circumferential yarn spools for better circumferential yarn tension control therefore higher quality woven material. Strength tests have demonstrated this improved quality.

While the invention has been described in its presently preferred embodiment it is understood that the words which have been used are words of description rather than words of limitation and that changes within the purview of the appended claims may be made without departing from the scope and spirit of the invention in its broader aspects.

What is claimed is:

1. A filament insertion device for use with a circumferential loom which holds a plurality of longitudinal threads in place and weaves a three-dimensional fabric from said longitudinal threads using thread received from said filament insertion device, said filament insertion device comprising;

a frame, wherein said frame includes a means of adjusting the filament insertion device tip so that it is in a first position when it dispenses a plurality of circumferentially placed threads, said adjusting means placing said filament insertion device tip in a second position when it dispenses weft thread;

a means for supplying said plurality of circumferentially placed threads with adjustable tensions, said supplying means being fixed to said frame;

a source of weft thread, said source being fixed to said frame;

a filament insertion device tip which receives and dispenses to said circumferential loom said plurality of circumferentially placed threads from said supplying means, and said filament insertion device tip dispensing said weft thread which it receives from said source; and a means for adjusting the tension of the circumferentially placed threads.

2. A filament insertion device, as defined in claim 1, wherein said supplying means comprises:

first and second spindles which are mounted upon said frame;

an upper yarn spool mounted upon said first spindle and supplying a first circumferentially placed thread;

a lower yarn spool mounted upon said second spindle and supplying said second circumferentially placed thread;

first and second tensionmeters which are mounted on said frame and which respectively control said first and second spindles so that the first and second threads are dispensed with adjustable tensions; and a means of feeding said first and second circumferentially placed threads to said filament insertion device tip.

3. A filament insertion device as defined in claim 2, including a shed finder tube which is connected to said filament insertion device tip to find a shed, said shed being and opening in said plurality of longitudinal threads into which said circumferential threads and said weaver threads are inserted to weave said three-dimensional fabric.

4. A filament insertion device, as defined in claim 3, wherein said source of weft thread comprises:

a spool of weft thread which is rotatably mounted upon said frame; and a weft thread feed tube which conducts said weaver thread in a tensionless stream to said filament insertion device tip.

* * * * *